United States Patent [19]

Long

[11] 4,143,621

[45] Mar. 13, 1979

[54] FUEL INJECTION SYSTEM WITH AUGMENTED TEMPERATURE SENSITIVE FUEL ENRICHMENT FOR TRANSIENT ENGINE LOADS

[75] Inventor: E. David Long, Elmira, N.Y.

[73] Assignee: Allied Chemical Corporation, Morris Township, Morris County, N.J.

[21] Appl. No.: 728,822

[22] Filed: Oct. 1, 1976

[51] Int. Cl.[2] ..... F02B 3/02

[52] U.S. Cl. ..... 123/32 EG; 123/32 EA

[58] Field of Search ..... 123/32 EH, 32 EG, 32 EF, 123/32 EA

[56] References Cited

U.S. PATENT DOCUMENTS

| | | | |
|---|---|---|---|
| 3,504,657 | 4/1970 | Eicher et al. | 123/32 EG |
| 3,566,846 | 3/1971 | Glockler | 123/32 EA |
| 3,971,354 | 7/1976 | Luchaco et al. | 123/32 EA |

*Primary Examiner*—Charles T. Jordan

*Attorney, Agent, or Firm*—Paul T. Kashimba; Roger H. Criss; John P. Kirby

[57] ABSTRACT

A fuel injection system for a spark ignited, internal combustion engine employs sensors which measure engine operating parameters to control the duration of actuating pulses applied to at least one fuel injector. One of the sensors measures engine temperature and the pulse duration is increased at lower engine temperatures to compensate for the lower volatility of the fuel at such lower temperatures. The output of a manifold vacuum sensor is differentiated to derive a signal proportional to the rate of increase of engine load and that is used in combination with the engine temperature sensor to increase the duration of an injector actuating pulse in amounts proportional to the rate of increase of engine load. The amount of increase in duration of the pulse varies inversely with engine temperature. This allows the enrichment of the fuel charge which normally occurs as an inverse function of engine temperature to be maintained at a level which may produce a leaner steady state air to fuel ratio during engine warm-up and to provide additional enrichment of the fuel charge during periods of increase transient engine load to provide reduced exhaust emissions during warm-up without stalling.

12 Claims, 3 Drawing Figures

FUEL INJECTION SYSTEM WITH AUGMENTED TEMPERATURE SENSITIVE FUEL ENRICHMENT FOR TRANSIENT ENGINE LOADS

BACKGROUND OF THE INVENTION

1. Field of the Invention

This invention relates to fuel injection systems for spark ignited, internal combustion engines of the type which monitor engine operating parameters and control a fuel charge to the engine as a function of those parameters and, more particularly, to such a system which provides an enrichment of the fuel charge during engine warm-up and increases that temperature sensitive enrichment during transient increases in engine load during warm-up.

2. Prior Art

Fuel injection systems which measure the operating parameters of a spark ignited, internal combustion engine and meter quantities of fuel controlled by the measurements to the engine cylinders have been in limited use for a number of years. Recent government regulations limiting the permissible quantities of atmospheric pollutants which may be present in vehicle engine exhausts and recent increases in petroleum costs have increased interest in these fuel injection systems as alternatives to conventional carburetors because of their superior ability to control the fuel flow to the engine. A fuel injection system in which the present inventor may be used and which has the ability to control the engine fuel flow to maintain the engine air to fuel ratio at a desirable value to minimize exhaust pollutants with acceptable fuel economy is disclosed in my United States patent application Ser. No. 629,421 entitled "Fuel Injection System" and filed on Nov. 6, 1975 now abandoned.

Injection systems typically control the quantity of liquid fuel that is provided to the engine but this fuel must be vaporized before the combustion reaction can take place. The vapor air to fuel ratio rather than the liquid air to fuel ratio provided by the fuel system determines the combustion process. The relationship of the liquid versus vapor air to fuel ratio depends on the volatility of the fuel, as well as fuel temperature and pressure. Volatility refers to the ease with which the fuel passes from the liquid into the vapor phase. If the injector system is well designed under certain operating conditions, such as cruising speed with a fully warmed-up engine, the entire injected fuel charge may be fully vaporized but, under other conditions, such as during acceleration of a relatively cold engine, an appreciable portion of the liquid fuel charge may not become vaporized and the injected quantity of fuel therefore must be augmented, that is enriched, to insure sufficient vaporized fuel to prevent the engine from stalling.

Fuel enrichment during engine warm-up is normally provided in many fuel injection systems. For example, my copending U.S. patent applications, Ser. No. 629,348 entitled "Fuel Injection System With Warm-Up Circuit," now abandoned, and Ser. No. 629,443 entitled "Control Computer for a Fuel Injection System," now U.S. Pat. No. 4,058,709, both filed on Nov. 6, 1975, disclose a fuel injection system employing a thermistor to monitor engine temperature and provide fuel enrichment to the engine during warm-up for engine temperature below normal operating conditions.

The fuel injection system disclosed in U.S. Pat. application Ser. Nos. 629,348 and 629,443 also employs a sensor which measures manifold pressure, which may be manifold vacuum, and modifies the fuel charge provided to the engine as a function of the manifold pressure to maintain the proper air to fuel ratio. In air throttled engines, an increased power demand by the engine occurs when a sudden decrease in manifold vacuum results from a sharp depression of the accelerator or a sudden increase in engine load, such as may be caused by shifting the engine from neutral into gear. The fuel injection system responds to such decrease in manifold vacuum by increasing the fuel charge provided to the engine. At normal engine operating temperatures, this increased fuel charge may be fully vaporized to provide the engine with the full fuel charge necessary to respond to the increased power demand. But, at lower engine operating temperatures, the fuel charge provided in response to a sudden decrease in manifold vacuum may not be fully vaporized and the resulting vaporized portion of the fuel charge may not be sufficient to allow the engine to meet the increased power demand without excessive exhaust emissions.

To avoid this situation, previous fuel systems have been designed to provide an adequate air to fuel mixture during cold engine conditions so that sufficient vaporized fuel will be present to allow the engine to respond to transient load increases during warm-up. However, such air to fuel mixture provided during warm-up transient load increases may be overly rich for the more or less steady state lighter engine load conditions. Such overly rich mixture under more or less steady state lighter engine load conditions will sharply increase emission of hydrocarbons and carbon monoxide from the engine. Catalytic convertors do not adequately solve this problem because they are not in full operation during warm-up.

SUMMARY OF THE INVENTION

The present invention is directed toward a fuel injection system that maintains a leaner air to fuel ratio during warm-up, yet avoids engine problems, such as engine stall, during the imposition of transient loads by a method and apparatus for augmenting the quantity of fuel enrichment during warm-up as a direct function of the rate of decrease of manifold vacuum and an inverse function of engine operating temperature. More particularly, the present invention provides a method and apparatus wherein the normal fuel enrichment provided to the engine during warm-up in response to a given set of engine conditions is augmented at engine temperatures below and the normal operating temperature and in which the augmented enrichment is increased as a function of the rate of decrease of manifold vacuum and as a function of engine temperature when a transient load is applied to the engine. Little or no augmented enrichment is provided at full engine temperature and maximum augmented enrichment is provided at cold engine temperature.

In the preferred embodiment of the invention, the fuel injectors are connected to a substantially constant pressure source of fuel. A variable width pulse generator receives sensor signals proportional to manifold vacuum, engine temperature and possibly other parameters and provides the injectors with actuating pulses having a duration which is a function of the sensor signals. The pulse duration is determined by the discharge time of a capacitor in a resistance-capacitance (R-C) timing circuit. The capacitor is charged to a voltage proportional to certain of the sensor inputs and, upon receipt of a triggering signal generated in timed relation to the engine operation, discharges to a lower voltage that depends upon other operating parameters including engine temperature.

The voltage to which the capacitor discharges is preferably determined by a voltage divider that has an engine temperature sensing means, such as a thermistor, in one of its legs, in parallel with a first calibration resistor that adjusts the discharge voltage that the capacitor sees during warm-up when the sensing means has its maximum resistance and has its greatest effect. A second resistor is connected in parallel with the resistance of the temperature sensing means through the emitter-collector function of a normally conducting transistor. The transistor base is connected to one side of a capacitor that has its other side connected to the manifold vacuum pressure sensor. When the manifold vacuum suddenly decreases, the transistor base voltage momentarily goes negative and increases the resistance of the emitter-collector path, thus momentarily diminishing the effect of the second parallel resistor. This increases the discharge voltage that the capacitor in the R-C timing circuit sees and lengthens the discharge time of that capacitor, thereby increasing, that is, augmenting the enrichment to the engine during warm-up. The engine thus has sufficient fuel to meet the increased transient power demand. If the manifold vacuum increases or remains substantially constant, the charge from the base of the transistor is removed so that it becomes more highly conductive and lowers the discharge voltage that the timing capacitor sees.

The amount of augmented fuel enrichment that is provided during a transient decrease in manifold vacuum caused by a sudden momentary increase in engine load is dependent upon the engine temperature as measured by the temperature sensing means in combination with the value of the second parallel resistor. When the engine is at normal operating temperature, the temperature sensing means has very little resistance and the function of the second resistor has little effect on the discharge voltage of the timing capacitor. When the resistance of the temperature sensing means is high, at reduced engine temperatures, the function of the second parallel resistor will have a greater effect on the discharge voltage seen by the timing capacitor. In effect, this augmentation of injector pulse duration as a function of the rate of decrease in manifold vacuum, on a temperature sensitive basis, compensates for the lower volatility of the injected fuel charge at low engine temperatures and low manifold vacuums. This allows the fuel to be metered to engine with a leaner air to fuel ratio than otherwise required during warm-up to reduce exhaust pollutants during warm-up without unnecessarily penalizing engine performance, such as by stalling, upon a sudden increase in engine load.

DESCRIPTION OF THE DRAWINGS

Other objectives, advantages and applications of the present invention will be made apparent by the following detailed description of a preferred embodiment of the invention. The description makes reference to the accompanying drawings in which.

DETAILED DESCRIPTION

Figure 1:
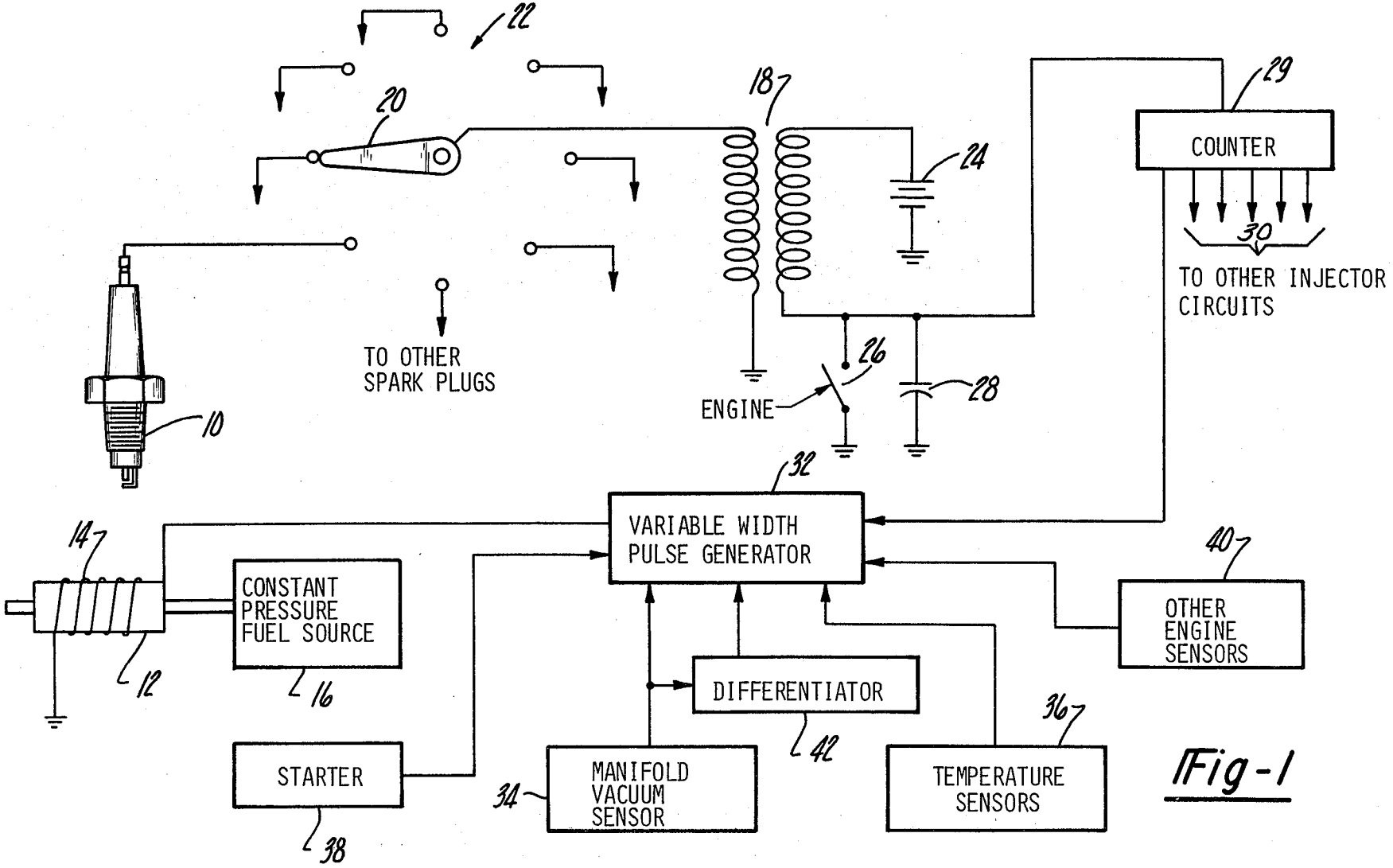
FIG. 1 is a partially block, partially schematic diagram of the engine ignition and fuel injection system employed with a preferred embodiment of the present invention.

The system of FIG. 1 illustrates the fuel injection and ignition components associated with a single cylinder of a multi-cylinder, spark ignited, internal combustion engine. The cylinder is equipped with a spark plug 10 and a normally closed fuel injector 12 which may be opened by electrically energizing its solenoid coil 14. The injector 12 is coupled to a constant pressure fuel source 16 and provides a volume of fuel to an engine intake valve externally of the cylinder each time the injector 12 is energized.

The spark plug 10 is energized by a conventional ignition coil 18 having its secondary circuit coupled to a rotor 20 of a distributor 22 driven by the engine. The spark plug 10 is connected to one of the distributor contacts, as are the other engine spark plugs. The primary circuit of the ignition coil 18 is energized by a vehicle battery 24 each time the breaker points 26 are opened. The operation of the breaker points 26, like the rotation of the distributor rotor 20, is powered by the engine and occurs in timed relation to the rotation of the engine. The breaker points 26 are shunted by a capacitor 28. Other forms of ignition systems, such as recently developed "solid state" systems, are equally useful with the invention.

The primary circuit of the ignition coil 18 is connected to a counter 29 which is advanced by the current pulses generated in the primary circuit by each actuation of the breaker points 26. The counter 29 has a number of output lines 30, equal to the number of injector circuits employed, which are sequentially energized as the counter 29 advances. The number of injector circuits employed depends upon the number of cylinders in the engine and the number of injectors which share a common circuit.

Only a single injector circuit is illustrated in FIG. 1. That circuit, which receives one of the counter output lines 30, employs a variable width pulse generator 32 that also receives signals provided by sensors which measure various engine operating parameters. These include: a differential or vacuum sensor 34 which measures intake manifold pressure, typically a vacuum, and provides a signal proportional to the mass of air flowing to the engine; an engine temperature sensor 36; a signal from the engine starter circuit 38 which indicates whether the engine is being started; and possible other inputs from sensors 40. These other inputs may measure other operation-related parameters such as ambient temperature, percentage of various constituents of the engine exhaust, etc.

The pulse generator 32 also receives the output of a differentiator circuit 42 which acts upon the output of the manifold vacuum sensor 34. Thus, the differentiator 42 provides the pulse generator 32 with a signal proportional to the rate of decreasing manifold vacuum.

Each time the generator 32 receives a triggering pulse from the counter 29, typically once each engine cycle during normal running operation of the engine, the generator 32 provides an electrical pulse to the solenoid coil 14 which opens the injector 12 to admit fuel from the fuel source 16 to the associated engine cylinder. The duration of the pulse and thus the volume of fuel injected is a function of all of the inputs to the generator 32. Similarly, the variable width pulse generator associated with the other engine cylinders provide actuating pulses to their associated injectors when they receive triggering signals from the counter 29. These other variable width pulse generators receive the same inputs as the pulse generator 32.

Figure 2:
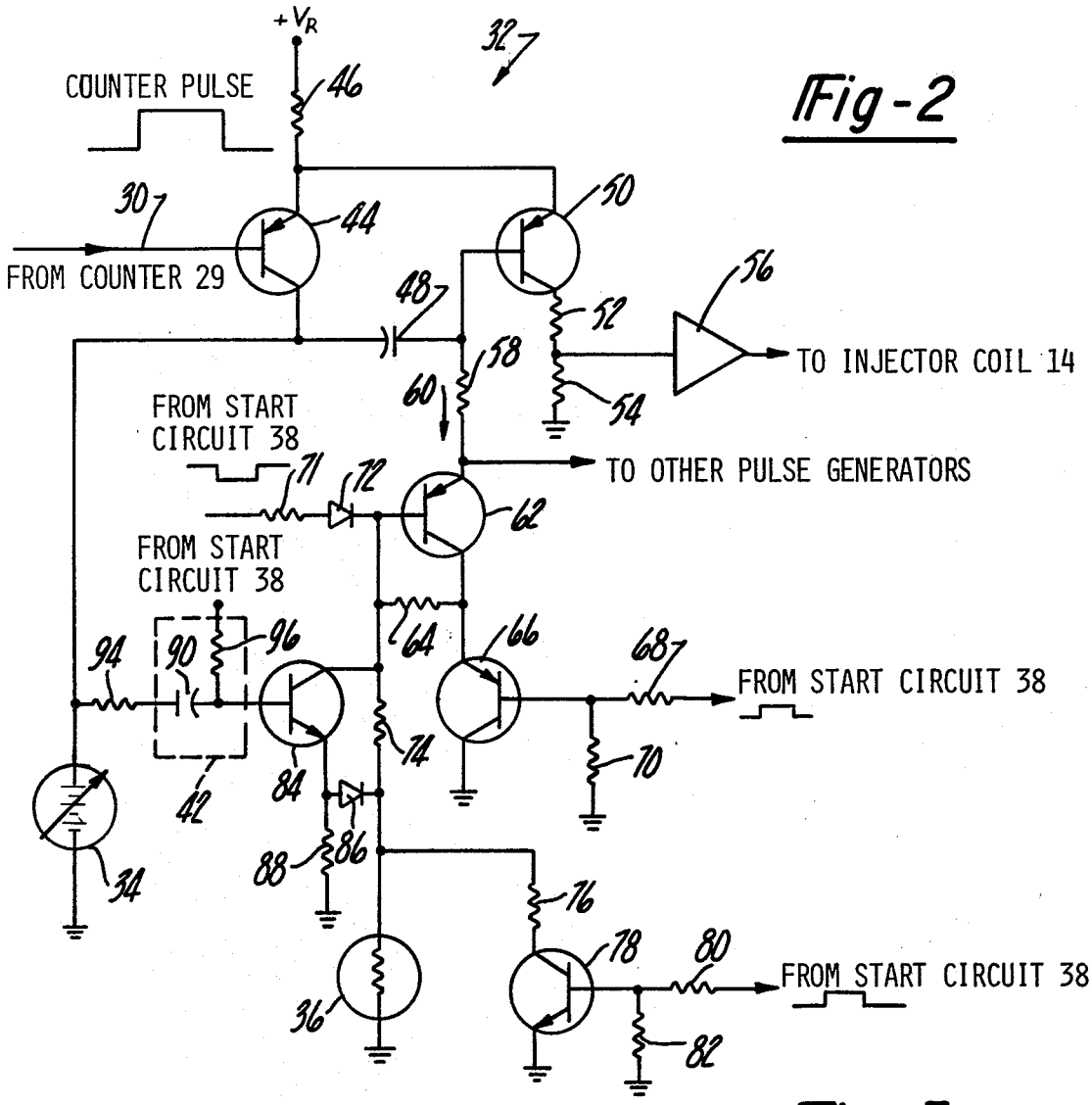
FIG. 2 is a more detailed schematic diagram of a portion of the variable width pulse generator employed in the preferred embodiment of the invention.

The circuitry of the pulse generator 32 is illustrated in more detail in FIG. 2. The illustrated circuitry includes certain elements which are common to the pulse generators associated with each of the cylinders.

The input pulses to the pulse generator 32 on line 30 are applied to the base of a PNP transistor 44 having its emitter connected to a positive reference voltage through a resistor 46. The collector of transistor 44 is connected to one side of a capacitor 48 forming part of a resistance-capacitance timing circuit. The collector of transistor 44 and the capacitance 48 are connected to the circuit of manifold vacuum sensor 34, which has its other end grounded. The circuit of vacuum sensor 34 acts as a variable voltage source, provides a voltage proportional to manifold vacuum and is schematically designated as such. As will be subsequently described, the circuit of manifold vacuum sensor 34 determines the voltage to which the capacitor 48 will be charged. In alternative embodiments of the invention, other engine sensing elements might be joined in association with the manifold vacuum sensor 34 to determine this voltage.

The other end of the capacitor 48 is connected to the base of a second PNP transistor 50 which has its emitter coupled to the emitter of transistor 44 and has its collector connected to ground through a pair of resistors 52 and 54. The midpoint of these resistors 52 and 54 is connected to an output driver circuit 56 and it provides the output pulse to the injector coil 14.

The base of transistor 50 and the capacitor 48 are connected to a resistor 58 which represents part of the discharge path of the capacitor 48 for a timing circuit. The other end of the resistor 58 is connected to circuitry, generally indicated at 60, shared by the variable width pulse generators for the other injector circuits, which acts with the resistor 58 and equivalent resistors in the other pulse generator circuits to determine the resistance of the discharge path of the timing capacitor 48 and the equivalent capacitors in the other pulse generator circuits.

Before the specific nature of that circuitry 60 is described, the operation of the circuitry heretofore described will be considered. A counter pulse from the counter 29 on line 30 takes the form of a positive going voltage and, in the absence of this trigger, the transistor 44 operates in a saturated conduction region. Transistor 50 is similarly conductive at this time and therefore there is no voltage on capacitor 48. Upon receipt of a positive going pulse on line 30, transistor 44 is switched out of conduction, allowing the capacitor 48 to charge to a voltage dependent upon the difference between the emitter voltage of transistor 50 and the variable voltage provided by the manifold vacuum sensor 34.

When the positive going pulse to the base of transistor 44 terminates, transistor 44 immediately becomes conductive again. The voltage at the base of transistor 50 goes sharply positive by an amount proportional to the difference between the voltage appearing at the emitter of transistor 44 and the output voltage of the circuit of vacuum sensor 34. The capacitor 48 then begins to discharge through the resistor 58 and a voltage across the equivalent resistance of circuitry 60. This discharge continues until the decaying voltage across resistor 58 becomes substantially equal to the emitter voltage of transistor 50, allowing transistor 50 to turn on and clamp the voltage on capacitor 48.

The time during which the transistor 50 is turned off if therefore dependent upon the variable voltage provided by the manifold vacuum sensor 34, which controls the voltage to which the capacitor 48 charges during the off time of transistor 44, and to a variable voltage source provided by the circuitry 60, which controls a voltage level to which the capacitor 48 must discharge after the transistor 44 becomes conductive. During this discharge time, a negative going pulse is provided to the driver circuit 56, causing it to generate an actuating pulse for the injector coil 14.

Considering the circuitry 60, the discharge resistor 58 is connected to the emitter of a PNP transistor 62 with a first parallel calibration resistor 64 connected between its base and collector. The collector of transistor 62 also connects to the emitter of another PNP transistor 66 which has its collector grounded, its base connected to the starter circuit 38 through a resistor 68 and to ground through a resistor 70. The base of transistor 62 is connected to the starter circuit 38 through a series combination of a resistor 71 and a diode 72 and to ground through a series combination of a resistor 74 and a temperature sensor 36, preferably taking the form of a thermistor having a resistance inversely proportional to the engine temperature. The thermistor preferably has a substantially zero resistance at normal operating temperature. The thermistor 36 is shunted by the series combination of a resistance 76 and the emitter-collector path of a NPN transistor 78 that has its base connected to the starter circuit 38 through a resistor 80 and to ground through a resistor 82.

The resistor 74 is shunted by a series combination of the emitter-collector circuit of an NPN transistor 84 and a diode 86. The emitter of transistor 84 is connected to ground through a second parallel resistor 88. The base of transistor 84 receives the output of the differentiator 42, which takes the form of a capacitor 90 connected to the manifold vacuum sensor 34, and a resistor 96. The base of transistor 84 is also connected to the starter circuit 38 through a resistor 96.

The starter circuit 38 connection to the resistor 71 provides a positive voltage to resistor 71 in the absence of energization of the starter circuit 38 and is grounded when the starter circuit 38 is energized during cranking of the engine. The positive voltage to resistor 71 acts as a reference voltage. The input provided by the starter circuit 38 to the bases of transistors 66, 78 and 84 is normally grounded and go positive when the starter circuit 38 is energized. The input provided by the starter circuit 38 to the base of transistor 84 through resistor 96 is normally positive and is grounded when the starter circuit 38 is energized. Accordingly, in the absence of energization of the starter circuit 38, during normal operation of the engine, transistor 66 is conductive and shorts the collector of transistor 62 to ground so that transistor 62 is rendered nonconductive. When the starter circuit 38 is energized, during engine cranking, transistor 66 is turned off, opening the circuit between the collector of transistor 62 and ground. The discharge resistor 58 is then connected to ground through the emitter-base junction of transistor 62, which acts as a diode. At the same time, transistor 78 is turned on, shunting the temperature sensor 36 to ground through resistor 76 which acts to calibrate the temperature sensor 36. At the same time, the reference voltage applied to resistor 71 and diode 72 is removed. Also during starting, removal of the positive voltage from the base of transistor 84 and resistance 96 renders transistor 84 nonconductive. Therefore, during starting, the capacitor 48 discharges to ground through the series combination of the resistors 58 and 74, and the temperature sensor 36 in combination with shunt resistor 76. Assuming that the resistance of the temperature sensor 36 may vary from about zero, in its fully warmed-up engine condition, to about ten times the value of resistor 58 at low temperature cold-start, the time constant of the resistance-capacitance timing circuit will vary by about a factor of 10 over a prescribed temperature range. Therefore, the width of the pulse generated by the pulse generator 32 will vary according to this ten to one range.

During normal engine operation, the transistor 62 acts as an emitter follower, connecting the resistor 58 to the positive reference voltage applied to the base of the transistor 62 from the starter circuit 38 through the resistor 71 and the diode 72. The resistance of temperature sensor 36 controls the proportion of the reference voltage at the junction of the resistor 58 and the emitter of transistor 62 and, thus, determines the voltage to which the capacitor 48 must discharge. The discharge time of capacitor 48 varies as a function of the voltage appearing at the emitter of transistor 62 and, thus, is directly proportional to the resistance of the temperature sensor 36. Thus, the resistor 58 and the temperature sensor 36 act as a voltage divider from the reference voltage applied to resistor 71. In this configuration, the change in the resistance of temperature sensor 36 which occurs between cold engine temperatures and normal engine running temperatures will produce a predetermined variation in pulse duration.

During normal engine operation, at substantially steady state manifold vacuums, the transistor 84 is conductive, shunting out the resistor 74 and connecting shunt resistor 88 so that only the resistance of the temperature sensor 36 in parallel with resistor 88 principally determines the proportion of the reference voltage which appears at the emitter of transistor 62.

When manifold vacuum decreases at a rapid rate, because of the imposition of a sudden load on the engine or the sudden depression of the accelerator, a positive voltage is applied to the base of transistor 84 by the capacitor 90, causing it to suddenly increase the resistance of the emitter-collector path of the transistor 84 and effectively removing shunt resistor 88 from the resistance of the temperature sensor 36 in the voltage divider circuit. Thus, a transient decrease in manifold vacuum and the resulting removal of shunt resistor 88 increases the voltage at the emitter of transistor 62 and increases the duration of the pulse generated by the pulse generator 32. The effect of the removal of shunt resistor 88 from across the temperature sensor 36 depends on the temperature of the engine at the temperature sensor 36, with effect diminishing to substantially zero when the engine reaches normal operating temperatures.

The duration of the transient enrichment thus provided over and above the normal steady state warm-up fuel enrichment provided depends upon the magnitude as well as the rate of change of decreasing manifold vacuum and is established by the constants of the differentiating circuitry formed by capacitor 90 and resistors 94 and 96.

Figure 3:
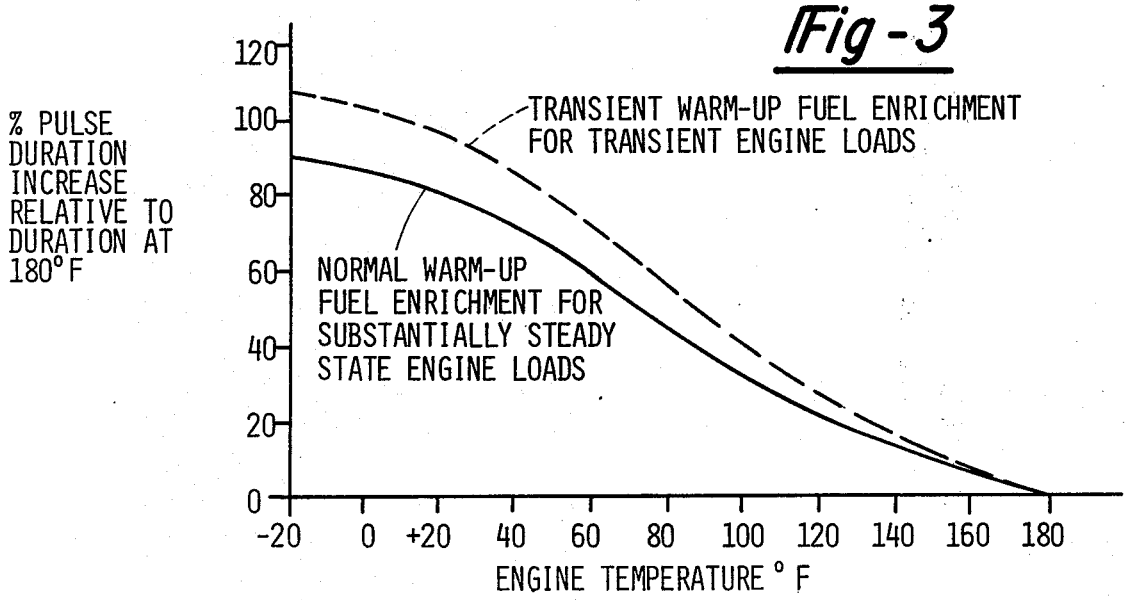
FIG. 3 shows plots of fuel enrichment to the engine during warm-up as a function of engine temperature, illustrating the temperature dependence of fuel enrichment provided for a given rate of decrease of manifold vacuum.

FIG. 3 is a plot of the percentage increase in pulse duration for varying engine temperatures relative to the pulse duration at normal engine operating temperature. The solid line in FIG. 3 plots normal warm-up fuel enrichment for substantially steady state engine loads, such as the normal warm-up fuel enrichment disclosed on my U.S. patent application Ser. No. 629,443. The dashed line in FIG. 3 plots the augmented transient warm-up fuel enrichment of the present invention for transient engine loads. For manifold vacuums existing under steady state engine loads, the normally provided fuel enrichment varies from substantially no fuel enrichment for normal engine temperatures at about 180° F. to a maximum fuel enrichment at cold engine temperatures of about −20° F. The degree augmented enrichment provided by the present invention for manifold vacuums existing under transient engine loads likewise increases from substantially no fuel enrichment for normal engine temperatures at normal engine operating temperatures of about 180° F. to a maximum fuel enrichment for cold engine temperatures of about −20° F.

With the present invention, the curve of enrichment with steady state manifold vacuums may be controlled so as to provide a leaner than stoichiometric air to fuel ratio to reduce exhaust during warm-up. When a transient power demand occurs, which lowers manifold vacuum, the enrichment level is augmented momentarily as a function of both the rate of decrease in manifold vacuum and engine temperature to provide the richer mixture transiently required.

I claim:

1. In a fuel injection system for a spark ignited, internal combustion engine including at least one fuel injector, means for sensing the engine manifold vacuum, means for sensing the engine operating temperature, and means for providing a quantity of fuel enrichment to the engine, an improvement comprising: means for augmenting the quantity of fuel enrichment provided to the engine during engine warm-up as a direct function of the rate of decrease of manifold vacuum and as an inverse function of engine operating temperature.

2. The fuel injection system of claim 1 wherein said means for augmenting the quantity of fuel enrichment provided to the engine during warm-up comprises: a variable width electrical pulse generator having its output connected to the injector; and means for controlling said variable width pulse generator as a function of said means for sensing manifold vacuum and said means for sensing engine operating temperature.

3. The fuel injection system of claim 2 wherein said means for controlling said variable width pulse generator comprises: electrical circuitry for differentiating an electrical signal generated by said means for measuring manifold vacuum.

4. The fuel injection system of claim 3 where said variable width pulse generator employs a resistance-capacitance timing circuit and said means for differentiating an electric signal generated by said means for sensing manifold vacuum is connected to said resistance-capacitance timing circuit so as to modify its operation as a function of the rate of decrease of manifold vacuum.

5. The fuel injection system of claim 4 wherein said resistance-capacitance timing circuit includes first means for varying the voltage to which a capacitor of said timing circuit discharges and second means for modifying said first means as a function of the output of said means for differentiating the output of said means for sensing manifold vacuum.

6. The fuel injection system of claim 5 wherein said variable width pulse generator includes a voltage divider having a first leg and a second leg, said first leg connected to the capacitor so that the ratio of resistance of the two legs determines the voltage to which the said capacitor discharges and said means for differentiating the output of said means for sensing manifold vacuum is connected to said voltage divider to vary the resistance of said second leg.

7. The fuel injection system of claim 6 and further comprising: a resistance element connected to said second leg of said voltage divider, a variable resistance switch means connecting said resistance element, and means for controlling the condition of the switch means as a function of the output of said means for differentiating the output of said means for sensing manifold vacuum.

8. The fuel injection system of claim 7 wherein said switch comprises a transistor having its emitter-collector path connected in series with said resistance element and its conductivity is controlled by said means for differentiating the output of said means for sensing manifold vacuum.

9. The fuel injection system of claim 1 wherein said means for sensing engine temperature comprises a thermistor.

10. The fuel injection system of claim 8 wherein said means for sensing engine temperature comprises a thermistor connected in said voltage divider in parallel with said resistance element.

11. A method for injecting fuel to a spark ignited, internal combustion engine during warm-up in response to transient engine loads comprising: sensing engine manifold vacuum; sensing engine operating temperature; augmenting a quantity of fuel enrichment provided to the engine as a direct function of the rate of decrease of manifold vacuum and as an inverse function of engine operating temperature.

12. In a fuel injection system for a spark ignited, internal combustion engine, a method for compensating during warm-up for decreased volatility of the fuel charge injected to the engine comprising: sensing engine manifold vacuum; sensing engine operating temperature; augmenting a quantity of fuel enrichment provided to the engine during warm-up as a direct function of the rate of decrease of manifold vacuum and as an inverse function of engine operating temperature.

* * * * *